United States Patent [19]

Rosen

[11] 4,235,053

[45] Nov. 25, 1980

[54] PROTECTIVE TABLE PAD LATCH

[75] Inventor: Norman J. Rosen, Altadena, Calif.

[73] Assignee: Hylo Table Pad Co., Inc., Pasadena, Calif.

[21] Appl. No.: 966,342

[22] Filed: Dec. 4, 1978

[51] Int. Cl.[3] ..... E04B 1/00

[52] U.S. Cl. ..... 52/127; 52/584

[58] Field of Search ..... 52/127, 584, 582; 292/102, 101, 103, 107, 202, 204, 209; 403/321; 160/231; 24/201 R

[56] References Cited

U.S. PATENT DOCUMENTS

| | | | |
|---|---|---|---|
| 156,486 | 11/1874 | Keator | 292/102 |
| 888,113 | 5/1908 | McKay | 160/231 R |
| 1,214,054 | 1/1917 | Mendenhall | 160/231 R |
| 1,712,320 | 5/1929 | Zitzerman | 52/127 |
| 1,712,373 | 5/1929 | Winter | 160/231 R |
| 1,852,323 | 4/1932 | Long | 160/231 R |
| 1,889,355 | 11/1932 | Greenhill | 52/127 |
| 2,581,816 | 1/1952 | Schlueter | 292/204 X |
| 3,661,410 | 5/1972 | Larson et al. | 52/127 |
| 4,020,613 | 5/1977 | Reynolds et al. | 52/584 X |

*Primary Examiner*—J. Karl Bell

*Attorney, Agent, or Firm*—Edward J. DaRin

[57] ABSTRACT

A protective table pad having corner plates secured between the top and bottom surfaces of a conventionally constructed table pad. The corner plates are defined to have a universal male-female construction to receive either the male or female end of a coacting latch element. The latch element is readily coupled and decoupled to the corner plate and when coupled may be swung into latching relationship with the corner plate of an abutting table pad.

19 Claims, 5 Drawing Figures

PROTECTIVE TABLE PAD LATCH

PRIOR ART AND SUMMARY OF THE INVENTION

Dining tables and similar articles of furniture are provided with highly polished and valuable surfaces that may be readily scratched or damaged in use. The damage to a table top may occur very readily when the table is used without any protective covering or the like. Protective pads are utilized over these table surfaces to protect them from scratches, mars, burns and other similar damage to the surfaces when the table is in use, such as during dining, or the like. Generally, two or more such protective pads are placed in an abutting relationship on the table surface to be protected for covering the entire surface to be protected when the table top is to be used. When a plurality of protective pads are used, they are prone to move or slide way from one another when in use. When the table pads are used, such as for dining, objects that are placed along the outer edges of the table pads may drop to the floor and break when a pad is moved or slid beyond the edge of the table. The prior art does recognize this problem and has proposed various types of latching mechanisms for latching the table pads together to prevent the aforementioned problem. The prior art patents that disclose means for latching table pads together are U.S. Pat. Nos. 888,113; 1,214,054; 1,712,320; 1,712,373 and 1,852,323. The latter U.S. Pat. No. 1,852,323 discloses a table pad for dining tables and similar classes of tables which includes two ordinary latches and hooks to join two separate table sections together. The latches and hooks are secured to the bottom of the table pads but don't touch the table because of the tapes that are used on the bottom of the pads to maintain a space between the table top and the bottom of the pads wherein the latches and hooks are located. The Zitzerman U.S. Pat. No. 1,712,320 discloses a furniture covering pad connector wherein the connector is secured in the center sandwich plane of the protective pad and moves in that plane. A rather elaborate connecting mechanism is disclosed. The remaining prior art patents show similar and various configurations of latching mechanisms for table top protectors. Latching mechanisms are also known in the prior art for latching panels together in various applications. Some typical panel fasteners that are known to the prior art are found in U.S. Pat. Nos. 2,714,751; 3,281,109; 3,661,410 and 4,020,613.

Economical and competitive construction of table pads in the present state of the art requires that there be a minimum interference with the laminating operation necessary for constructing a protective table pad. At the present time, the laminating operations for constructing a table pad include the steps of cementing the layers or laminations and applying pressure to them to integrate them into a unitary table pad structure. Also, it has been found that to simplify and reduce the cost of fabrication, uniform and standard treatment of all of the internal corners of a table pad is desirable and thereby eliminate any special tooling requirements and special handling by personnel when constructing a latching type pad as when constructing a non-latching type pad. At the present time it is advantageous to construct both types of protective pads by procedures that are essentially identical and use the same tooling. Consistent with this desire to construct both type of protective table pads by similar procedures and tooling, it has been found that it is highly undesirable to mount a latching element on certain internal corners of a table pad and latch receptors on another. Accordingly, there is a need for a latching mechanism or system that can be readily adapted to present day manufacturing techniques for manufacturing protective table tops that can be used as a standard or common insert that can be uniformly embedded in all internal corners of the table pads for defining a latching construction or system.

The present invention provides an improved latching mechanism that can be economically constructed and readily integrated into the conventional manufacturing procedures presently utilized for manufacturing protective table pads. A minimum number of changes are necessary in the present day procedures for manufacturing non-latching protective table pads for producing a latching mechanism for integration into the manufacture of conventional table pads. The latching mechanism of the present invention comprises a common insert or corner plate that may be readily secured into the internal corners of conventional table pads and can be utilized as both a female and male latching element. The common corner plate is integrated into each internal corner of a protective pad so as to be essentially invisible. The latch member can be independently manufactured from the table pad proper and is of construction that allows it to be readily coupled and decoupled to a mounting post provided for the coacting corner plate. By suitably disposing the latch members of the present invention in one-half of the internal corners for a pair of the protective pads, the arrangement of the pads will allow center sections or pads to be added or removed, or even rotated 180° without interferring with the latching function.

The simplicity of construction of the latching mechanism of the present invention and the minimum additional cost in manufacturing the protective pads will permit the standard corner latching elements to be embedded into table pads that are not sold as a latching table pad. This allows the non-latching table pad to be upgraded at a later time through the sale of the latching member per se so as to readily convert the table pad to a latchable table pad when the need arises.

From a manufacturing standpoint, the present invention comprehends a method of manufacturing a protective table pad capable of being latched to a similarly constructed table pad arranged in side-by-side relationship. The method steps include constructing a conventional laminated structure for defining a protective table pad or the like adapted to overlie a surface to be protected. During the construction of the table pad, diagonally cutting one of the interior laminations at a pair of adjacent corners for each protective pad, and then securing a corner plate having a latching post at the cutout sections of the laminations to adapt the protective pad to be latched to another protective pad that is constructed with a similar corner plate. The manufacture is completed by constructing a latch member to be removably secured to the latching post of one of the corner plates for swinging movement toward the latching post of another corner plate to be latched thereto.

From an overall construction standpoint the protective pad of the present invention comprises a plurality of protective surface pads of conventional construction adapted to overlie the top of a surface to be protected when placed on the surface in a side-by-side abutting relationship. Each internal corner of each pad is provided with a corner plate secured within the pad intermediate the top and bottom surfaces of the pad. The corner plates for adjacent corners of abutting pads are arranged in the same horizontal plane. The corner plates themselves comprise a pair of similarly defined plates secured together with a preselected spacing between the plates, the spacing being selected to permit a latch member to be freely moved between the spaced plates. Each secured pair of plates includes a post member secured to each plate adjacent to and inwardly of the internal corner of each pad arranged in abutting relationship. A latch member is provided that is adapted to be removably secured to the post member for one of the corner plates so as to be pivotable about the post member for latching engagement with the post member for the corner plate secured in the abutting pad to thereby latch the pads together so that they move in unison. The latch member is essentially embedded in the pads when it is swung into a latched position with the post members to thereby prevent scratching or marring the surface to be protected as a result of the use of the latch member.

These and other features of the present invention may be more fully appreciated when considered in the light of the following specification and drawings, in which.

Figure 1:
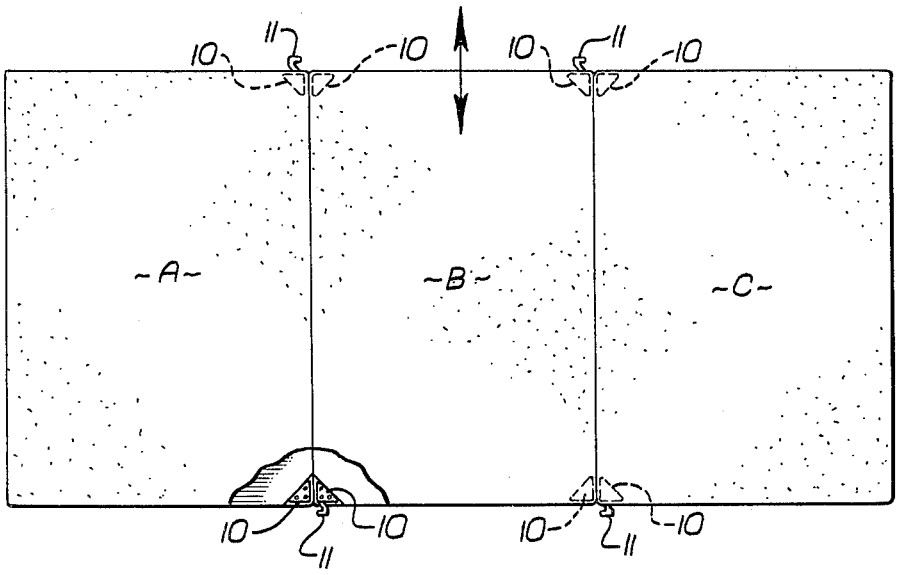
FIG. 1 is a diagrammatic representation of a plurality of protective table pads having a latching mechanism integrated therein and with portions broken away to illustrate the latching mechanism embodying the present invention.

Now referring to the drawings, the latching table pad structure of the present invention will be described in detail. The general organization of three latchable table pads are illustrated in FIG. 1 as they may be arranged on a surface to be protected in a side-by-side, abutting relationship. The pads are identified in FIG. 1 as the pads A, B, C reading from left to right as illustrated. Each internal corner of the pads A, B, and C are provided with a corner plate 10. Each pad has at least a single latching element 11 swingably secured to one of the corner plates 10 at the opposite corners thereof, as is evident from examining FIG. 1. The latching elements 11 are illustrated in an unlatched condition. In the arrangement of the table pads illustrated, the center pad B may be moved out of position or between the pads A and C without affecting the latching function afforded by the pads A and C. When the table pad B is removed, such as when the center leaf of a dining table is removed, the pads A and C can be moved together and latched without any modification of the latching structure as contemplated by the present invention.

Figure 2:
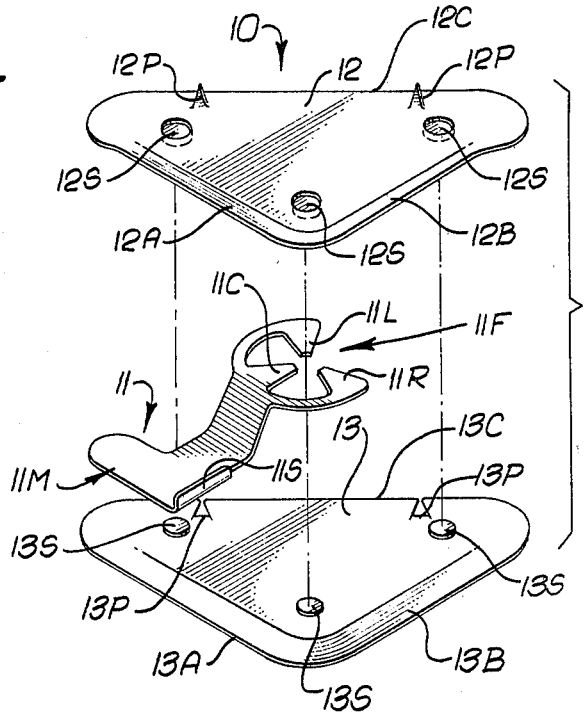
FIG. 2 is an exploded view of the elements of the latching mechanism of the present invention detached from a table pad.

The structure of a corner plate 10 is clearly illustrated in FIG. 2 wherein the corner plate elements are illustrated with the latching element 11 in an exploded relationship. The elements of the corner plate 10 are also illustrated in FIG. 2 in a detached condition with respect to one another, while in FIG. 1, they are illustrated in their assembled condition with the latching element 11 coupled to the corner plates 10. The individual, triangular corner plates comprising the assembly 10 are illustrated and identified in FIG. 2 as the plates 12 and 13. The corner plate 13 best illustrates the three slugs 13S arranged adjacent the corners of the triangular plate 13. The slugs 13S are produced by punching the plate on the opposite side from the side illustrating the slugs 13S but maintaining the slugs in their protruded condition after the plate 13 is punched. Similar slugs 12S are constructed and defined for the plate 12 and are identified as the slugs 12S illustrated in dotted outline. The slugs 12S and 13S are utilized in accordance with the present invention to define posts P for spacing the assembled plates 12 and 13 apart. The slugs 12S and 13S preferably protrude from the inner face of the respective plates 12 and 13 a distance on the order of 0.014 inches to correspond to the thickness of a conventional lamination utilized in manufacturing a table pad; i.e., 0.028 inches. The plates 12 and 13 are assembled by mounting the plate 12 over the plate 13 with the slugs 12S and 13S in engagement and then the slugs 12S and 13S are spot welded together to form the posts P and the unitary assembly comprising the corner plate 10. The edges of the corner plate 12, identified as the edges 12A and 12B, are curled up or turned upwardly from the horizontal plane of the plate 12, as illustrated in FIG. 2. Similarly, the edges 13A and 13B for the the corner plate 13, are curled or turned downwardly from the horizontal plane of the plate 13. Accordingly, when the plates 12 and 13 are assembled with the aforementioned edges adjacent one another, the edges coact to provide a larger opening for more readily accepting a latching element placed therebetween. Similarly, the edges identified as the edges 12C and 13C for the plates 12 and 13 respectively, are provided with a means for connecting the assembled corner plate 10 to the table pads proper. Each of the edges 12C and 13C are defined with a pair of sharp barbs that protrude transverse to the horizontal plane of the plates 12 and 13. As illustrated in FIG. 2, the barbs 12P protrude upwardly from the face of the plate 12. The corresponding barbs 13P arranged along the edge 13C for the plate 13 protrude downwardly from the horizontal plane of the plate 13 as illustrated in FIG. 2. It should be noted that only one configuration for the plates 12 and 13 need be fabricated in accordance with the present invention, and the plates oriented in opposite senses for the welding step; see FIG. 2.

Figure 3:
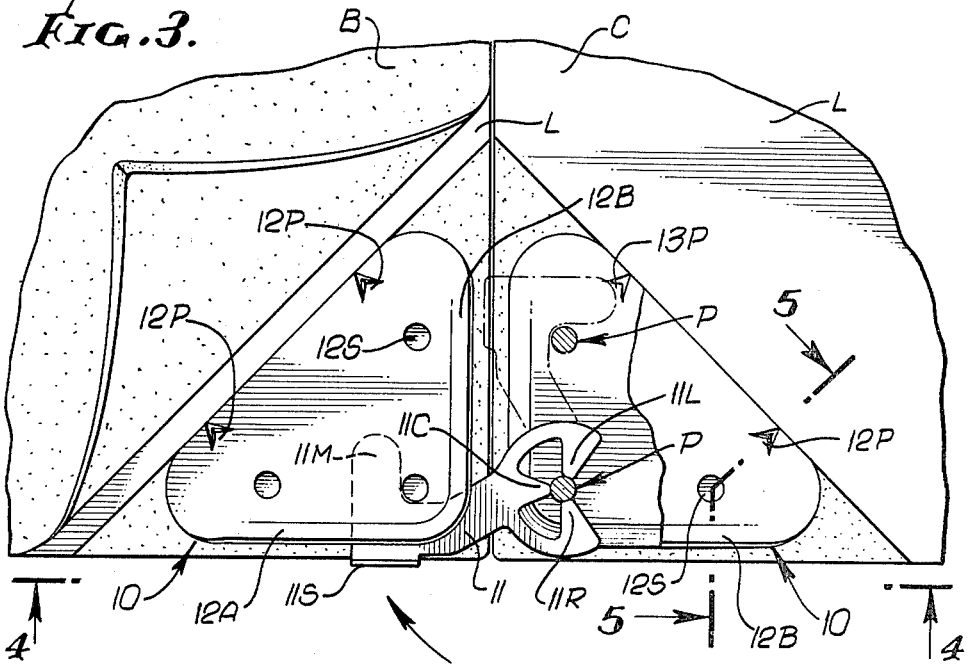
FIG. 3 is a partial illustration of a pair of abutting table pads having a latching mechanism integrated therein and illustrated in a latched condition.

The assembled corner plate 10 that is constructed as described hereinabove, preferably has a thickness that corresponds to the aforementioned thickness of one of the laminations conventionally used in present day table pads exclusive of the aforementioned turned or curled edges and the pad securing barbs. The standard laminations for the purpose of the present invention are diagonally cut at an internal corner and the corner plate 10 is inserted in the area normally occupied by the severed portion of laminations L as can be best appreciated by examining FIG. 3. Accordingly, this requires merely the severing of the laminations L at each internal corner during manufacture of the pad and locating the assembled corner plates 10 at the severed corners of the laminations L to convert a non-latching table pad to a latching table pad. When assembled into the table pad proper, as illustrated in FIG. 3, the edges 12A, 12B, 13A and 13B of the plates 12 and 13 respectively, are arranged along the internal corners of the table pad to allow access to the mounting posts P which are arranged between the aforementioned edges. The barbs 12P and 13P are on the inside edges 12C and 13C of the plates 12 and 13 and protrude into the adjacent laminations of the table pad to secure the corner plate 10 to the table pad proper. In this arrangement, the mounting post P arranged adjacent the internal corner functions for coupling the latching element 11 to the Post P at either the female or male end thereof as will become evident immediately hereinafter. It should be recognized at this point that a non-latching table pad can be adapted for a latching operation without the provision of a latch 11 by merely constructing it in conventional fashion and adding the corner plates 10 so that it can be fully converted to a latching pad at a later date by the provision of a latch element 11.

Figure 4:
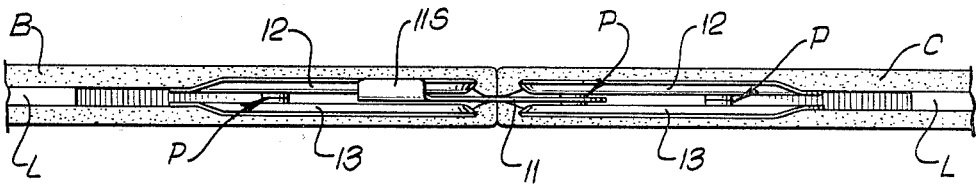
FIG. 4 is a sectional view taken along the line 4—4 of FIG. 3.
Figure 5:
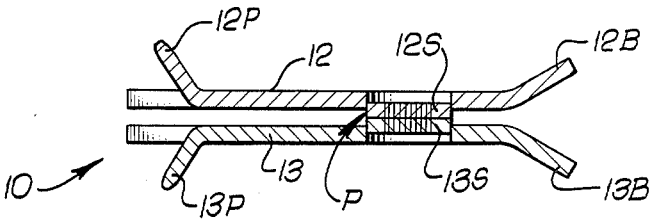
FIG. 5 is an enlarged sectional view of a corner plate taken along the line 5—5 of FIG. 3.

The latch element 11 that is utilized with the corner plate assembly 10 is best illustrated in FIG. 2. The latch element 11 may be constructed of a flat, single sheet with a female coupling element 11F defined at one end thereof for detachably coupling the latch member to the post member P for one of the corner plates 10. The latch element 11 also has a male latching member 11M defined to have a latching arm extending a preselected distance outwardly of the longitudinal axis of the latch element 11 in a direction transverse to the longitudinal axis. The female coupling 11F is constructed and defined to be removably snap locked to the post P of the corner plate 10 for permitting pivotal movement of the latch member 11 about a secured post P. The female coupling element 11F of the latch element 11 is defined as having a socket-like cavity having a plurality of spaced locking fingers 11L, 11C and 11R extending into the cavity, as best illustrated in FIG. 2. The locking fingers 11L and 11R are arranged in spaced alignment with each other and transverse to the longitudinal axis of the latching element 11 and adjacent the end of the socket opening of the female end 11F. A single locking finger 11C is arranged between the pair of spaced locking fingers 11L and 11R and is defined in coincidence with the longitudinal axis of the latching member 11 so that the latching fingers may slidably receive a Post P at the outer ends of the fingers so as to be pivotable about the post, see FIG. 3. The configuration of the male end of the latching element 11 or the end 11M is defined with a protrusion extending transverse to the longitudinal axis for defining an internal latching corner to be secured to a post P of one of the corner plates 10. This configuration is defined to prevent movement of the latched post and thereby the secured table pad longitudinally beyond the transverse protrusion of the latch element and to prevent the protrusion 11M from moving beyond the post 13S. The latching element 11 is further provided with an upstanding stop member 11S for engaging and being secured to the exterior surface of a latch pad and to provide means for grasping the latch member 11 to pivot it to an unlatched position exterior of the pad, as illustrated in FIGS. 3 and 4.

It should now be appreciated from the above description that during the manufacturing of the table pads, the manufacturing procedures are altered to a minimum extent for converting a conventional table pad to a latching table pad. During the construction of the conventional table pad, the laminations, such as lamination L identified in FIG. 3, is severed diagonally at the internal corners thereof. The volume previously occupied by the severed portion of the lamination L is occupied by the assembled corner plates 10. The corner plates 10 are oriented with the upturned edges 12A, 12B and 13A and 13B arranged adjacent the sides of the table pads that define the internal corner. This allows better access to the mounting post 13S sandwiched between the plates 12 and 13. The corner plates 10 are secured in the table pads proper by the provision of the barbs 12P and 13P arranged on the plates 12 and 13 respectively. The securing function provided by the barbs 12P and 13P is augmented, in practice, by applying a suitable adhesive to the inside surfaces of the top and bottom laminations to cement these laminations to the exterior surfaces of the plates 12 and 13 for a corner plate 10. This secures the corner plates 10 in a fixed relationship with respect to the internal corner. Accordingly, the mounting post P defined between the edges 12A, 12B and 13A and 13B, functions as a male-female mounting post for the latching element 11. Once the table pads are thus manufactured and ready to be placed on a surface to be protected, the latching element 11 may be secured to the mounting post P in any desired pattern, with one such arrangement of the latching elements 11 being illustrated in FIG. 1. The latching element 11 is snap locked to the post P by means of the resilient fingers 11L, 11C and 11R so as to engage and encompass the mounting post P in a swingable relationship. Once the latching elements 11 are mounted to a post P, the element extends outwardly of the pad as illustrated in FIG. 1. The latching element 11 may then be rotated about the post P wherein the male member 11M of the latch element 11 is swung into engagement with the post P for the abutting table pad as illustrated in FIGS. 3 and 4. The male end of the latching element 11, or the end 11M is secured to the post 13S as illustrated in FIG. 3 to prevent movement of the post and thereby the secured table pad longitudinally beyond the transverse protrusion 11M of the latch member 11 and to prevent the protrusion 11M from moving inwardly beyond the post P. When the latching element 11 is thus arranged in a latching position, the upstanding stop member 11S for the element 11 is engaged with and secured to the exterior of the latched pad, such as the pad B illustrated in FIGS. 3 and 4 to thereby provide means for grasping the latch member 11 and pivot it in a counterclockwise direction, as illustrated in the drawings, so that it can be moved to an unlatched position exterior of the pad to permit relative movement between the pads.

For storage purposes, i.e., when the table pads are not to be used, the latch element 11 may be stored within the corner plate 10 to which it is coupled by rotating it clockwise from the latched position illustrated in FIG. 3 to the position illustrated in dotted outline to be secured to the adjacent post P of the same corner plate 10 to which the female end is coupled.

The material selected for manufacturing the corner plates 12 and 13 is preferably a stainless steel sheet of 26 gauge. The preferred material for the latch element 11 is a spring steel, hardenable material that is especially suitable for permitting the resilient fingers 11L, 11C and 11R to return to their original positions after being expanded to snap over a post P. It is contemplated that the structure of the latching system of the present invention may also be optionally fabricated from a thermoplastic material by injection molding techniques.

It should now be evident that an improved and simplified latching structure that can be inexpensively manufactured has been disclosed and that may be readily integrated into present day manufacturing techniques for non-latching table pads.

What is claimed is:

1. A protective pad comprising a plurality of protective surface pads of conventional construction adapted to overlie the top of a surface to be protected when placed on the surface in a side-by-side abutting relationship, each internal corner of each pad being provided with a corner plate secured within the pad intermediate the top and bottom surfaces of the pads, the corner plates for adjacent corners of abutting pads being arranged in the same horizontal plane, the corner plates comprising a pair of similarly defined plates secured together with a preselected spacing between the plates, the spacing being selected to permit a latch member to be freely moved between the spaced plates, each secured pair of plates including a post member secured to each plate adjacent to and inwardly of the internal corner of each pad arranged in abutting relationship, and a latch member being adapted to be manually secured to and detached from the post member for one of the corner plates, without any tools, so as to be pivotable about the post member for latching engagement with the post member for the corner plate secured in the abutting pad to thereby latch the pads together so they move in unison, the latch member being essentially embedded in the pads when the latch member is swung into a latched position with said post members to thereby prevent scratching or marring the surface to be protected, the latch member being manually removable from a secured post member when it has been pivoted out of latching engagement with the post member for said abutting pad.

2. A protective pad as defined in claim 1 wherein said latch member is constructed and defined with a female coupling at one end constructed and defined for permitting it to be manually snaplocked to a post member for one of the corner plates to thereby allow the latch member to be readily pivoted about the post member.

3. A protective pad comprising a plurality of protective surface pads of conventional construction adapted to overlie the top of a surface to be protected when placed on the surface in a side-by-side abutting relationship, each internal corner of each pad being provided with a corner plate secured within the pad intermediate the top and bottom surfaces of the pads, the corner plates for adjacent corners of abutting pads being arranged in the same horizontal plane, the corner plates comprising a pair of similarly defined plates secured together with a preselected spacing between the plates, the spacing being selected to permit a latch member to be freely moved between the spaced plates, each secured pair of plates including a post member secured to each plate adjacent to and inwardly of the internal corner of each pad arranged in abutting relationship, and a latch member adapted to be removably secured to the post member for one of the corner plates so as to be pivotable about the post member for latching engagement with the post member for the corner plate secured in the abutting pad to thereby latch the pads together so they move in unison, said latch member being constructed and defined with a female coupling at one end for permitting it to be removably secured to a post member for one of the corner plates to thereby allow the latch member to be readily pivoted about the post member, the latch member being essentially embedded in the pads when the latch member is swung into a latched position with said post members to thereby prevent scratching or marring the surface to be protected, the latch member being further characterized as being constructed of a single piece of flat resilient material with the female coupling end being constructed and defined of a circular configuration with an open end for receiving a post to be latched thereto and with a plurality of spaced, resilient latching fingers defined to extend inwardly of the internal periphery of the circular configuration to an extent to engageably surround the post to be latched when latched thereto and to allow the latch to be pivoted around the post by means of the latching fingers moving around the post in response to the pivoting movement.

4. A protective pad as defined in claim 3 wherein the latch member is constructed and defined with a male latching member on the end opposite to the female coupling so as to engage a post to be latched so that a pair of latched protective pads cannot be horizontally separated when moved over the top of a protected surface.

5. A protective pad as defined in claim 4 wherein the latch member has three spaced latching fingers with the post receiving open end being spaced in horizontal alignment with a central latching finger and the male latching member having an upstanding stop member for limiting the pivoting movement of the latch member against the protective pad.

6. A protective pad as defined in claim 5 wherein the male end of the latch member is of a substantial L configuration with the stop member extending a preselected distance vertically for abutting engagement with the edge of the pad to which it is latched or the pad to which the latch member is coupled for storage purposes.

7. A protective pad as defined in claim 1 wherein the latch member comprises a flat member having a female coupling member at one end for detachably coupling the latch member to the post member for one of the corner plates and a male latching member defined to have a latching arm extending a preselected distance outwardly of the longitudinal axis of the latch member in a direction transverse to the longitudinal axis, the female coupling member being constructed and defined to be removably snap-locked to the post member for permitting pivotal movement of the latch member about the post member.

8. A protective pad as defined in claim 7 wherein said corner plates comprise a pair of substantially triangular shaped plates secured together in a spaced relationship for receiving the latch member therebetween, the plates including a latching post arranged adjacent one of the corners of the secured plates for receiving the latch member.

9. A protective pad as defined in claim 8 wherein said corner plates are metallic plates with each of the plates being punched adjacent each corner of the triangle and with the punched out slugs remaining attached to the plates and then securing the plates together by welding the plates together at said slugs to thereby define latching posts.

10. A protective pad as defined in claim 9 wherein said corner plates are defined along two sides with turned edges, the turned edges of the plates being turned in opposite directions from the horizontal planes of the attached plates for increasing the spacing between the plates along said two sides to thereby facilitate the reception of the latch member therebetween.

11. A protective pad as defined in claim 9 wherein the corner plates include means for securing the plates to a pad intermediate the top and bottom surfaces of the secured pad.

12. A protective pad as defined in claim 11 wherein the securing means for the corner plates comprise a plurality of spaced barbs defined adjacent the remaining side of the corner plates.

13. A protective pad as defined in claim 12 wherein said spaced barbs comprise a plurality of spaced, sharp barbs spaced along the remaining edges of each corner plate and defined integrally with each plate and extending transverse to the plane of each plate to extend in securing engagement with the secured table pad.

14. A latching assembly for use with a protective table pad to permit a pair of pads arranged in abutting relationship to be latched together, the table pads being of a laminated construction with one of the laminations of the pad being modified from its normal construction by having the internal corners of the laminations severed diagonally at each internal corner, the latching assembly being constructed and defined to be interfitted at the severed area of the lamination, the latching assembly comprising a pair of substantially triangular plates secured together in a spaced relationship, the spacing between the plates being defined relative to the thickness of the severed lamination to permit the plates to be secured in the space previously occupied by the severed lamination, the secured plates including a latching element adjacent one corner of the assembled plates and spaced between the plates to be accessible from the severed corner of the lamination, and a latching member swingably secured to said latching element between the secured plates so as to be pivotable about said latching element to be latched to the corresponding latching element for a pair of plates secured to an abutting protective pad, the latching member is of one piece construction with one end having a socket-like cavity having a plurality of spaced locking fingers extending into the cavity, a pair of spaced locking fingers being arranged in spaced alignment with each other and transverse to the longitudinal axis of the latching member and with one locking finger arranged between said pair of spaced, locking fingers and arranged in coincidence with the longitudinal axis of the latching member so that the latching fingers slidably receive a latching element in the form of a post at their outer ends so as to be pivotable about the post, the opposite end of the latching member having a protrusion extending transverse to the longitudinal axis for defining a latching corner to be secured to a latching element in the form of a post to prevent movement of the post and thereby the pad longitudinally beyond the transverse protrusion of the latch member and to prevent the protrusion from moving beyond said post.

15. A latching assembly as defined in claim 14 wherein the opposite end of the latch is provided with an upstanding stop member for engaging and being secured to the exterior of a latched pad to provide means for grasping the latch member to pivot it to an unlatched position exterior of the pad.

16. A method of manufacturing a protective table pad capable of being latched to a similarly constructed table pad arranged in side-by-side relationship comprising constructing a conventional, laminated structure for defining a protective table pad or the like adapted to overlie a surface to be protected, diagonally cutting one of the interior laminations at a pair of adjacent corners for each protective pad, completing the construction of the table pad by securing a triangular corner plate having a latching post at the cut out sections of the laminations to adapt the protective pad to be latched to another protective pad that is constructed with a similar triangular corner plate, and constructing a latch member to be manually secured and detached from the latching post of one of the corner plates for one of the table pads for swinging movement toward the latching post of said another corner plate of the table pad arranged adjacent thereto to be latched thereto.

17. A method of interlocking a plurality of protective pads positioned on a surface to be protected in an abutting relationship including the steps of providing corner elements having a universal latching structure so as to be capable of functioning as a male or female coupling element, each corner element being adapted to slidably receive a latching element for engagement with said latching structure, embedding a corner element in each protective pad at each internal corner thereof, the corner elements being embedded within the protective pad intermediate the top and bottom layers thereof and extending a preselected distance along each corner edge to permit access to the latching structure, coupling one end of the latching element to the latching structure for a corner element embedded in one protective pad for swinging movement toward the corner element for the abutting protective pad, said latching element has a female coupling element at one end and a male coupling element at the opposite end and the universal latching structure for the corner element will each secure either female or male ends of the latching elements interchangeably, and swinging the latching element into latching engagement with the latching structure for the corner element of said abutting protective pad to thereby prevent the abutting pads from separating in use.

18. A method of interlocking a plurality of protective pads positioned on a surface to be protected in an abutting relationship as defined in claim 17 including repeating the latter two steps for the other internal corner for the abutting pads.

19. A method of interlocking a plurality of protective pads positioned on a surface to be protected in an abutting relationship as defined in claim 17 wherein the latching element is coupled for swinging movement to the corner elements of different pads.

* * * * *